US008288636B1

(12) United States Patent
Rahn

(10) Patent No.: US 8,288,636 B1
(45) Date of Patent: Oct. 16, 2012

(54) CONTOURED GUITAR PICKUP SELECTOR SWITCH KNOB

(76) Inventor: Stephen Rahn, San Francisco, CA (US)

( * ) Notice: Subject to any disclaimer, the term of this patent is extended or adjusted under 35 U.S.C. 154(b) by 0 days.

(21) Appl. No.: 13/169,197

(22) Filed: Jun. 27, 2011

(51) Int. Cl.
*G10D 3/10* (2006.01)

(52) U.S. Cl. ..... 84/297 S

(58) Field of Classification Search ..... 84/290; 200/302.3, 293, 329–332
See application file for complete search history.

(56) References Cited

U.S. PATENT DOCUMENTS

| | | | | |
|---|---|---|---|---|
| 2,189,845 A | | 2/1940 | Terrill | |
| 4,482,792 A | * | 11/1984 | Geremia | 200/302.3 |
| 4,539,886 A | | 9/1985 | Hoffart | |
| 4,745,837 A | | 5/1988 | Rimsa | |
| 6,114,616 A | | 9/2000 | Naylor | |
| 6,253,654 B1 | | 7/2001 | Mercurio | |
| 2011/0113946 A1 | * | 5/2011 | Van Ekstrom | 84/291 |

* cited by examiner

*Primary Examiner* — Kimberly Lockett
(74) *Attorney, Agent, or Firm* — Steven A. Nielsen; Allman & Nielsen, P.C.

(57) ABSTRACT

The invention is for a solid body type guitar having a pickup selector switch located closely adjacent to the volume controls. The invention is a specially developed pickup selector switch tip knob having an extension arm which is contoured to conveniently fit the human finger for easy manipulation of the pickup selector switch. The contoured extension arm can have one or both sides contoured to accommodate easy pickup selection from either direction with the guitar player's hand. The invention can be mounted on the pickup selector switch post such that the extension arm is facing either toward the guitar strings or away from the guitar strings.

7 Claims, 3 Drawing Sheets

CONTOURED GUITAR PICKUP SELECTOR SWITCH KNOB

CROSS-REFERENCE TO RELATED APPLICATIONS

N/A

STATEMENT REGARDING FEDERALLY SPONSORED RESEARCH

N/A

THE NAMES OF THE PARTIES TO A JOINT RESEARCH AGREEMENT

N/A

INCORPORATION-BY-REFERENCE OF MATERIAL SUBMITTED ON A COMPACT DISC

N/A

BACKGROUND OF THE INVENTION (1) Field of the Invention

This invention is directed to improving the playability of a particular design of guitar, known as a Telecaster®. The guitar player for this type of guitar must manipulate two control knobs on the guitar along with a "pickup selector switch" all while picking the guitar strings. The present invention is useful in providing a convenient contoured extension to a standard knob which makes this task considerably easier to accomplish.

(2) Description of Related Art Including Information Disclosed Under 37 CFR 1.97 and 1.98

U.S. Pat. No. 2,189,845, issued to C. J. Terrill, on Feb. 13, 1940, for "KNOB", which discloses a circular knob on the pickup selector switch, which is apparently still in use today.

U.S. Pat. No. 4,539,886, issued to Dean Hoffart, on Sep. 10, 1985, for "GUITAR", discloses a simple toggle switch on the pickup switch for the purpose of changing sound pickups for the guitar.

U.S. Pat. No. 6,114,616, issued to Joseph Naylor, on Sep. 5, 2000, for "GUITAR BODY", which discloses a circular knob on the pickup selector switch.

U.S. Pat. No. 4,745,837, issued to Daniel Rimsa, on May 24, 1988, for "INTERNALLY ILLUMINATED ELECTRIC GUITAR", which discloses a circular knob on the pickup selector switch.

U.S. Pat. No. 6,253,654, issued to Peter Mercurio on Jul. 3, 2001, for "ELECTRIC STRINGED INSTRUMENT WITH INTERCHANGEABLE PICKUP ASSEMBLIES WHICH CONNECT TO ELECTRONIC COMPONENTS FIXED WITHIN THE GUITAR BODY", discloses the circular knob on the pickup selector switches.

BRIEF SUMMARY OF THE INVENTION

The invention is a specially developed pickup selector switch tip knob having an extension arm which is contoured to conveniently fit the human finger for easy manipulation of the pickup selector switch.

DETAILED DESCRIPTION OF THE INVENTION REFERENCE NUMERALS

Figure 1:
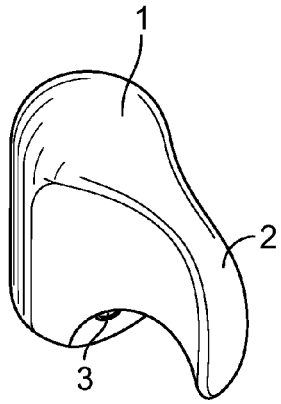
FIG. 1 is a side view of the invention from an upper perspective

1—pickup switch tip body for a Telecaster® or similar guitar 8 probably composed of a single piece of metal, plastic, resin or wood, which said pickup switch tip body 1 can be fitted and securely anchored to a selector type pickup switch post 4 for use by the guitar player 2—contoured extension arm to the pickup switch tip body 1, or "wing", which due to its convenient contoured extension arm 2, enables the guitar player to move the pickup selector switch post 4 without touching the guitar volume control 6 knob causing an unwanted change in sound volume, the contoured extension arm 2 may have a single contour, or both sides may be contoured, wherein one or both sides of the contoured extension arm 2 may have a striated or otherwise roughened surface to provide a non-slip grip for the guitar player 3—set screw anchor is screwed into the threaded opening 7 in the pickup switch tip body 1 that when fully screwed into and impacting the pickup switch 4 anchors the pickup switch tip body 1 onto the pickup switch post 4 for use and manipulation by the guitar player 4—pickup switch post is the post on which the pickup switch tip body 1 is mounted by pressing it onto the pickup selector switch post 4 using the pickup switch opening 5 in the pickup switch tip body 1

5—pickup switch opening in the pickup switch up both 1, for insertion of the pickup switch post 4

6—guitar volume control is the circular knob mounted on the guitar closest to the pickup switch post 4

7—threaded opening is where the set screw anchor 3 is threaded into and tightened to anchor the pickup switch body 1 onto the pickup switch post 4

8—guitar body which is a Telecaster® or similar solid body guitar

DETAILED DESCRIPTION OF THE DRAWINGS

FIG. 1 is a side view of the invention from an upper perspective, which shows the pickup switch tip body 1, the contoured extension arm 2 is shown in a single contour configuration, and a partial view of the set screw anchor 3 as inserted into the threaded opening 7.

Figure 2:
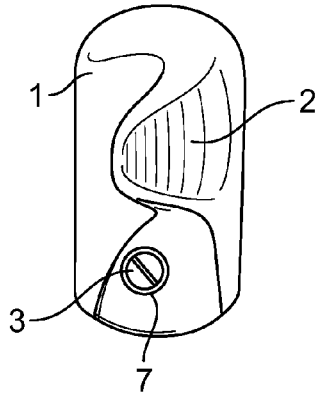
FIG. 2 is a side view of the invention

FIG. 2 is a side view of the invention which shows the pickup switch tip body 1, the contoured extension arm 2 is shown in a single contour configuration, and a partial view of the set screw anchor 3 as inserted into the threaded opening 7.

Figure 3:
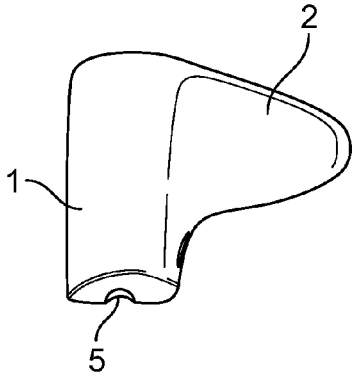
FIG. 3 is a side view of the invention from a lower perspective

FIG. 3 is a side view of the invention from a lower perspective which shows the pickup switch tip body 1, the contoured extension arm 2, and a partial view of the pickup selector switch opening 5 in the pickup switch tip body 1

Figure 4:
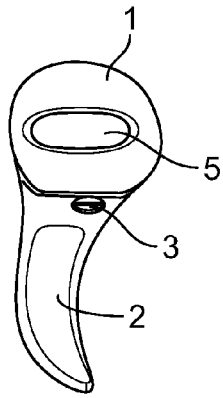
FIG. 4 is a bottom view of the invention

FIG. 4 is a bottom view of the invention which shows the pickup switch tip body 1, the contoured extension arm 2 is shown in a single contour configuration, and a view of the pickup switch opening 5 in the pickup switch tip body 1, with a partially inserted set screw anchor 3.

Figure 5:
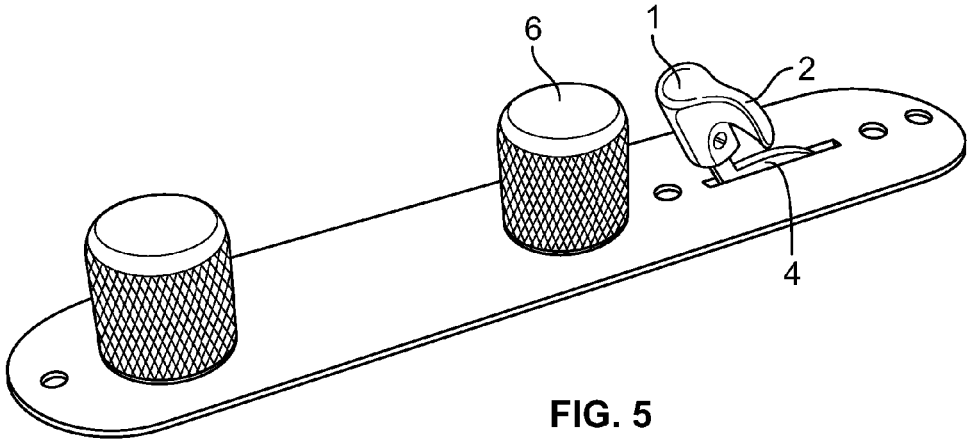
FIG. 5 is a side view of the guitar control structure showing the invention mounted on the pickup selector switch post
Figure 6:
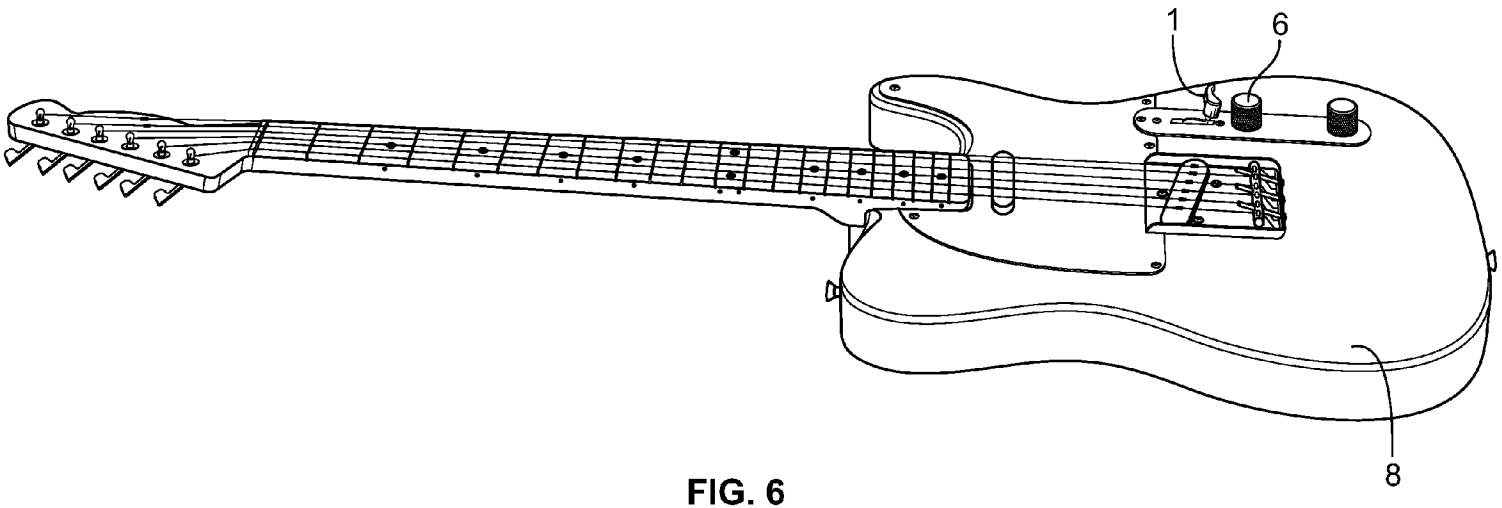
FIG. 6 shows a guitar with the control structure mounted on the guitar with the invention shown on the control structure
Figure 7:
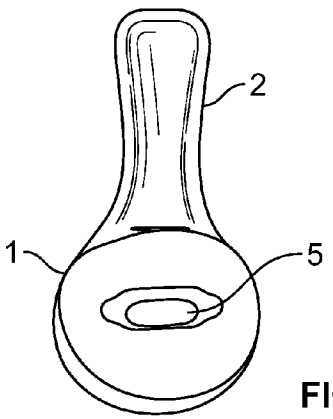
FIG. 7 is a bottom view of the invention showing a straight variation of the contoured extension arm with contours on both sides with a bulbous tip

FIG. 5 is a side view of the guitar control structure showing the pickup selector switch tip body 1 mounted on the pickup selector switch post 4, immediately adjacent to the guitar volume control 6 circular knob, the contoured extension arm 2 is shown in a single contour configuration so as to be engaged by the guitar player while playing the guitar FIG. 6 shows a guitar with the control structure mounted on the guitar body 8 with the pickup switch tip body 1 in which thee contoured extension arm 2 is shown in a single contour configuration, with the pickup switch tip body 1 mounted on the pickup selector switch post 4, immediately adjacent to the guitar volume control 6 circular knob FIG. 7 is a bottom view of the invention showing a straight variation of the contoured extension arm 2 with contours on both sides of the contoured extension arm 2 and with a bulbous tip at the end of the contoured extension arm 2 that affords an easy bi-directional grip by the guitar player and allows for mounting the invention in an upward orientation with the arm 2 pointing toward the guitar strings.

Figure 8:
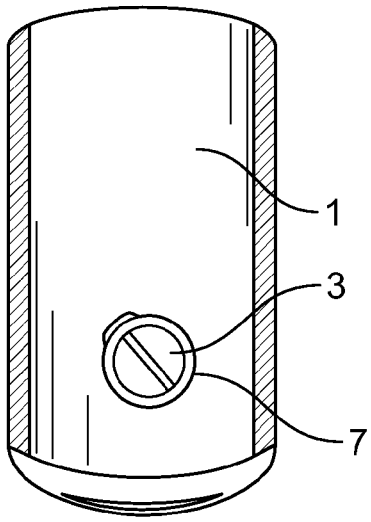
FIG. 8 is a rear view of the invention showing the variation in which the anchor means is located on the rear of the invention

FIG. 8 is a rear view of the invention showing the variation in which the anchor means (3, 7) is located on the rear of the invention, in this variation, the contoured extension arm 2 is longer than in other invention variations and has a "reverse" contour that allows the pickup switch tip body 1 to be mounted on the pickup switch post 4 so that the contoured extension arm 2 faces toward the guitar strings rather than away as depicted in FIG. 6.

Figure 9:
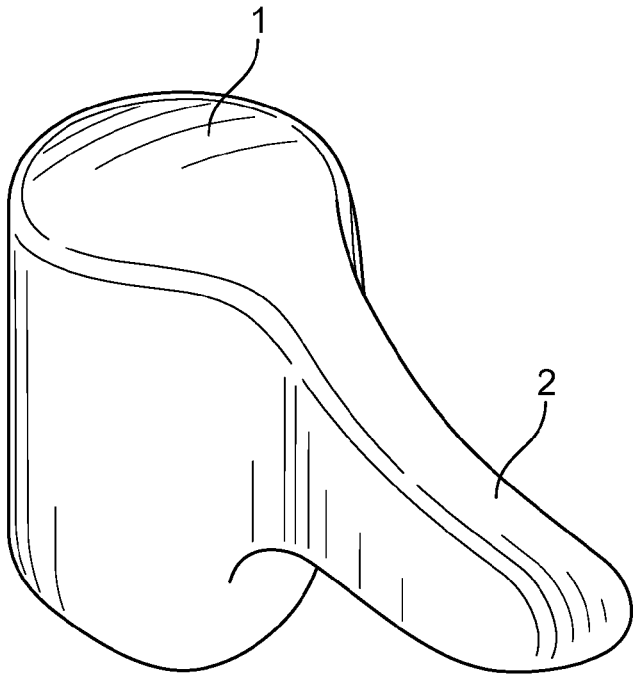
FIG. 9 is a front view of the invention showing the variation in which the contoured extension arm 2 is longer and a reverse contour

FIG. 9 is a front view of the invention showing the variation in which the contoured extension arm 2 is longer and a "reverse" contour that allows the pickup switch tip body 1 to be mounted on the pickup switch post 4 so that the contoured extension arm 2 faces toward the guitar strings rather than away as depicted in FIG. 6.

DETAILED DESCRIPTION

The Telecaster®, a solid body guitar 8, has a plurality of models, but is generally a dual-pickup, solid-body electric guitar. Its design and revolutionary sound production broke ground and set trends in electric guitar manufacturing and popular music. Introduced in the autumn of 1949, it was the first guitar of its kind to be produced on a substantial scale. Its commercial production can be traced as far back as March 1950, when the single- and dual-pickup Esquire models were first sold. The Telecaster® has been in continuous production in one form or another since its first introduction.

In its basic form, the guitar is simply constructed, with the neck and fingerboard comprising a single piece of maple, which is bolted to an ash or alder guitar body 8 which has been jig-sawed to achieve the contoured look to the guitar body 8 with flat surfaces on the front and back.

The hardware includes two single coil sound pickups controlled by a three-way CRL or equivalent selector switch, and one each of volume 6 and tone controls. The guitar pick guard is typically plastic and is screwed directly onto the guitar body 8 with screws.

The early pickup switch configuration allows selection of three different types of sound pickup. The first position, manipulates the treble tone and in the second position, neck pickup with normal tone. The third switch position selected the bridge pickup with neck pickup blended in, depending on the position of the second "tone" knob. The first knob functioned normally as a master volume control 6. In order to make the pickup switch selection, there is a pickup switch post 4 which is moved by the player to make the selection.

Some of the newer pickup selector switch configurations now have different functionality, the 3-way toggle switch in the first position selects neck pickup only, the second position for neck and bridge pickups together, and the third position for bridge pickup only. The first knob adjusts the master volume 6; the second control knob is a master tone control affecting all the pickups.

Unfortunately, the designers and manufacturers of the Telecaster®, solid body guitar 8 placed the pickup switch post 4 too close to the volume control knob 6, making it very difficult for the guitar player to change pickup selector switch settings without inadvertently changing the volume by moving the volume control knob 6. This situation is made worse because the prior art guitars, as covered previously, use a simple circular top knob mounted onto the pickup switch post 4.

There has been a long-term perceived need for an improvement on this oversight, which is satisfied by the present invention. Here, instead of a simple round knob as in the prior art, the present invention pickup switch tip body 1 has a contoured extension arm 2 or "wing", as a part of its construction that is easily manipulated by the hand or fingers of the guitar player, probably the little finger, without touching the volume control 6. It is expected that the invention will have multiple variations to accommodate diverse guitar playing styles.

For example, a reversed version (FIG. 9) of the invention may be mounted upward, pointing toward the strings (see FIG. 8 and FIG. 9), to bring the switch tip closer to the player's fingers and accommodate different playing styles. A reversed version (FIG. 9) is also appropriate for left handed mounting.

The contoured extension arm 2 often has a roughened surface to allow for easy and sure grip by the guitar player in moving the pickup switch between its positions. The pickup switch tip body 1 is mounted onto the pickup selector switch post 4 using the pickup switch opening 5 in the pickup switch tip body 1. Since the guitar player may put pressure on the pickup switch tip body 1 during manipulation of the pickup switch during play, the pickup switch tip body 1 is securely anchored to the pickup switch post 4 using a threaded opening 7 in the side of the pickup switch tip body 1 where a set screw anchor 3 is screwed into the threads to hold the pickup switch tip body 1.

The anchor means for the pickup switch tip body 1 is comprised of a threaded opening 7 in the side of the pickup switch tip body 1 where a set screw anchor 3 is screwed into the threads to hold the pickup switch tip body 1. The anchor means of the threaded opening 7 can be placed either in the front of the pickup switch tip 1 body (FIGS. 1, 2, 3, 4, 5, 6 and 7) or on the rear of the pickup switch tip 1 body (FIGS. 8 and 9).

It is contemplated that other means could be used to securely affix the pickup switch tip body 1 to the pickup selector switch post 4 such as a tapered pickup switch opening 5, or a specialized type of anchor for this purpose.

What is claimed is:

1. A contoured pickup selector switch knob comprising:

a pickup switch tip body for an electric type guitar electric type guitar having a pickup selector switch post for mounting said pickup switch tip body thereto;

a contoured extension arm as an integral portion of said pickup switch tip body, the contoured extension arm extending outwardly from said pickup switch tip body with one side of said contoured extension arm being contoured in shape; and means for affixing said pickup switch tip body to said pickup selector switch post so as to prevent said pickup switch tip body from coming loose during use.

2. The contoured pickup selector switch knob of claim 1, wherein said contoured extension arm has a roughened contour surface.

3. The contoured pickup selector switch knob of claim 1, wherein said contoured extension arm has both sides in a contoured shape with a bulbous ending tip on said contoured extension arm.

4. The contoured pickup selector switch knob of claim 1, wherein said means for affixing said pickup switch tip body to said pickup selector switch post comprises an opening in a base of said pickup selector switch post and a threaded opening in one side of said pickup switch tip body accommodating a complementary threaded anchor screw.

5. The contoured pickup selector switch knob of claim 1, wherein the contoured side of said contoured extension arm faces in either direction.

6. A contoured pickup selector switch knob comprising:

a pickup switch tip body for an electric type guitar said electric type guitar having a pickup selector switch post for mounting said pickup switch tip body thereto;

a contoured extension arm integrated into said pickup switch tip body, the contoured extension arm extending outwardly from said pickup switch tip body with one side of said contoured extension arm being contoured in shape; and said pickup switch tip body having a threaded opening on a side portion and said pickup switch tip body having a base and an opening in the base.

7. A contoured pickup selector switch knob comprising:

a pickup switch tip body for an electric type guitar said electric type guitar having a pickup selector switch post for mounting said pickup switch tip body thereto;

a contoured extension arm as an integral portion of said pickup switch tip body, the contoured extension arm extending outwardly from said pickup switch tip body with one side of said contoured extension arm being contoured in shape and the contoured extension arm comprised of a roughened or smooth contour surface; and means for affixing said pickup switch tip body to said pickup selector switch post so as to prevent said pickup switch tip body from coming loose during use.

* * * * *